US005078073A

United States Patent [19]

Betz et al.

[11] Patent Number: 5,078,073

[45] Date of Patent: Jan. 7, 1992

[54] METHOD AND APPARATUS FOR A LIFEBOAT SAFETY STROP

[75] Inventors: John M. Betz, Capitola; John D. Vitkauskas, Novato, both of Calif.

[73] Assignee: Chevron Research and Technology Company, San Francisco, Calif.

[21] Appl. No.: 565,389

[22] Filed: Aug. 9, 1990

[51] Int. Cl.[5] ..... B63B 21/00

[52] U.S. Cl. ..... 114/337; 114/378; 114/379; 294/82.27

[58] Field of Search ..... 114/44, 259, 365, 367, 114/368, 369, 370, 371, 372, 373, 374, 375, 376, 377, 378, 379, 380; 405/3; 294/82.24, 82.27

[56] References Cited

U.S. PATENT DOCUMENTS

| | | | |
|---|---|---|---|
| 555,018 | 2/1896 | Pike | 114/377 |
| 2,356,279 | 8/1944 | Simonds | 114/377 |
| 3,383,721 | 5/1968 | Gilbert | 114/377 |
| 4,586,453 | 5/1986 | Wilks et al. | 114/369 |
| 4,610,474 | 9/1986 | Jaatinen | 114/378 |
| 4,878,450 | 11/1989 | Schmidt | 114/259 |

*Primary Examiner*—Jesus D. Sotelo
*Assistant Examiner*—Stephen P. Avila
*Attorney, Agent, or Firm*—E. J. Keeling; M. W. Carson

[57] ABSTRACT

An apparatus provides additional safety during the launching of survival craft from a ship or platform by which it is attached. A safety strop is comprised of a connecting line which is attached at its upper end to a means for lowering a launch pendant and a lifeboat. the lifeboat is equipped with an on load release means for launching it. The lower end of the connecting line is attached to a released means such as a shackle or a pelican hook. The connecting line release means is releaseably connected to a hang off lug assembly, which is attached to the on load release means. The connecting line has a longer length than the launch pendant, so that no load is carried by the connecting line unless the lifeboat is prematurely released from the launch pendant.

20 Claims, 5 Drawing Sheets

METHOD AND APPARATUS FOR A LIFEBOAT SAFETY STROP

BACKGROUND OF THE INVENTION

The present invention relates generally to launching a survival craft such as lifeboat, rescue craft, or like small boat from a ship, a floating or fixed offshore marine platform or other vessel by which it is carried. More specifically, this invention provides a safety apparatus for preventing the accidental free fall of such a lifeboat.

BACKGROUND OF THE INVENTION

Launching survival craft from a ship, a floating or fixed offshore platform or other vessel by which it is carried for emergency escape can be in the face of a combination of adverse circumstances such as listing, darkness, smoke, fire on board, fire on the sea, toxic or flammable gas, and high winds. It is therefore desirable to launch the survival craft in a manner that is safe and that can be repeatedly practiced by crew members.

Current industry standards utilize a means for lowering a launch pendant which is reasonably secured to the survival craft. By "launch pendant", we mean any lowering means such as a line, cable, strop, strut, rod, chain, tube, or any combination thereof, which may be used to lower a survival craft. Systems such as the Viking on load release gear or Titan on load release gear are designed to release the survival craft from the launch pendant upon being lowered into a proper position in the water. However, accidents have occurred where the on load release gear prematurely released the survival craft before the craft reached the proper position in the water, or upon improper release as the craft was hoisted back up to its regular, stored position.

The hydrostatic operating unit of the on load release mechanism needs to be accurately set for a particular load, for the system to work properly. Also, the lift hook must be properly locked into place to prevent accidental release of the life boat upon raising or lowering the life boat. The system design of the on load release mechanism is such that the officer in charge could be led to believe that the lift hook was properly set when in fact it was not. This is especially true if the lift hooks are reset prior to resetting the release hook arm.

Prior work with survival craft launching techniques have not included a safety device to prevent accidental freefall of the survival craft. Wilks et al received U.S. Pat. No. 4,586,453, which discloses a method for launching a lifeboat in a bows-out heading, away from the vessel it was mounted on. While this method does make the procedure of launching a lifeboat safer, it does not teach a method of preventing accidental freefall of the survival craft. Wilks et al specifically teaches the use of on load release gear with a hydrostatic operating unit so that the craft cannot be accidentally released. There is no mention of even the need for a back up system for the on load release gear for the situation where the release gear is not correctly adjusted or where it prematurely releases.

Schmidt received U.S. Pat. No. 4,878,450 which discloses a lifting device for small boats, which is attached to the rear vertical surface of a larger boat. Schmidt's device does not incorporate an on load release mechanism such as that preferred by Wilks et al. Instead, Schmidt uses a system of horizontal and vertical tubes to raise and lower a lifeboat.

The prior work is limited in the attempts to safely raise and lower rescue craft in that no attempt has been made to incorporate a back-up device to prevent accidental freefall of the survival craft. Current methods therefore fall short of providing adequate safety measures. There is therefore a need for a backup safety device for use in conjunction with the on load release gear that are currently used as an industry standard.

SUMMARY OF THE INVENTION

The present invention is surprisingly successful in providing a safety apparatus useful in the launching of survival craft such as a lifeboat from a ship or platform by which it is carried.

A safety strop is comprised of a connecting line which has an upper and a lower end. The upper end is attached by a shackle or other suitable attaching means to a means such as a Miranda system for lowering a launch pendant and a lifeboat. The lifeboat is equipped with an on load release means which releasably connects to the lower end of the launch pendant. The lower end of the connecting line is connected to a connecting line release means, such as a shackle or a pelican hook.

The connecting line release means is releasably connected to a hang off lug assembly, which is fixedly attached to the on load release means. The connecting line has a length that is longer than the length of the launch pendant so that no load is carried by the connecting line unless the second lower end of the launch pendant is released from the on load release means.

It is an object of the present invention to provide a safety apparatus which relates to launching a survival craft such as a lifeboat, rescue craft, or like small boat from a ship, a floating or fixed offshore marine platform or other vessel by which it is carried.

It is also an object of the present invention to provide a safety strop wherein the upper end of the connecting line is merged with the upper end of the launch pendant to form one swedged eye, which is attached to a shackle. It is desirable that all parts of the safety strop be comprised of galvanized steel to prevent rusting.

It is another object to provide a safety strop wherein the connecting line release means is a shackle. The shackle is releasably connected to a hang off lug assembly by a release pin, which is attached to the shackle by a safety wire. The lug assembly is fixedly attached to the on load release means.

It is a further object of this invention to provide a safety strop such that the connecting line release means is a pelican hook, which is releasably connected to the hang off lug assembly by a securing ring which is slidably and pivotally attached to the pelican hook.

An additional object of this invention is to provide a safety strop such that the on load release mechanism is a "Viking" on load release mechanism. In another object, the on load release mechanism is a "Titan" on load release mechanism.

The above and other objects, advantages, and features of the method of the invention will become more readily apparent from the following detailed description of the invention, which is provided in connection with the accompanying drawings.

DETAILED DESCRIPTION OF THE INVENTION

In accordance with the present invention, a new improved method and apparatus for providing greater safety measures during the raising and lowering of survival craft has been developed.

The current industry practice of raising and lowering survival craft to and from larger vessels by the use of a means such as a Miranda system to lower a launch pendant and the craft, can be improved.

Figure 1:
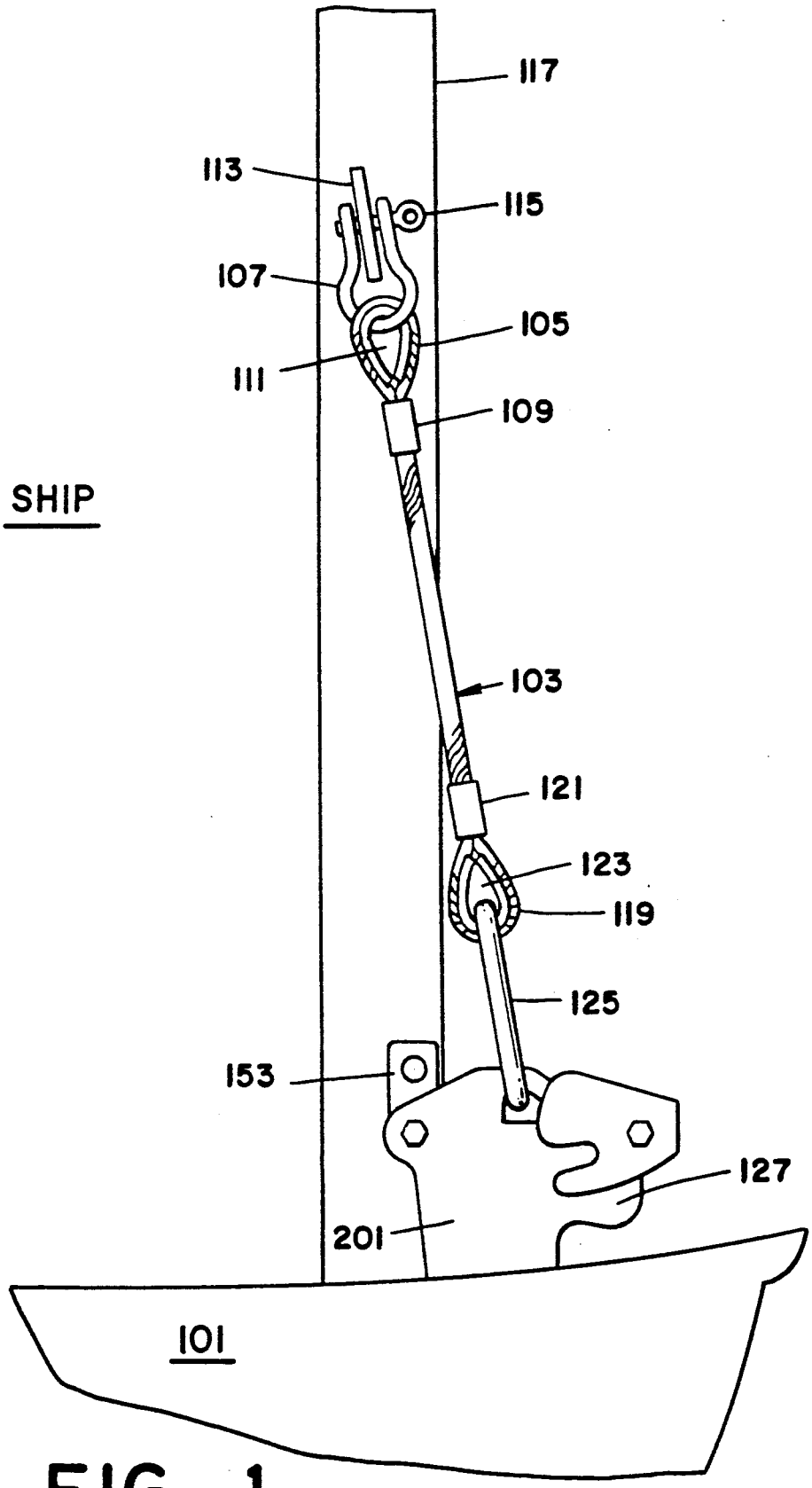
FIG. 1 is a side view that illustrates a ship carrying a lifeboat by means of a launch pendant.

FIG. 1 displays a ship which carries a lifeboat 101 by means of a launch pendant 103. The launch pendant 103 has a first, upper end 105 that is connected to a shackle 107. The upper end 105 of the launch pendant has been clamped by steel clamp 109 to form a swedged eye 111. The shackle 107 is pivotally connected to a padeye 113 by a pin 115. The padeye 113 is fixedly attached to a means for lowering the launch pendant 103 and lifeboat 101 into the water. Here, a Miranda system 117 is utilized.

All components described in FIGS. 1-5 are generally comprised of galvanized steel to prevent rusting. Launch pendant 103 is comprised of galvanized steel cable.

The second, lower end 119 of the launch pendant 103 is also clamped by a steel clamp 121 to form a swedged eye 123 to connect the launch pendant 103 to a steel ring 125. The steel ring 125 releasably connects the launch pendant 103 to the lifeboat 101 by means of an on load release mechanism 127.

Figure 2:
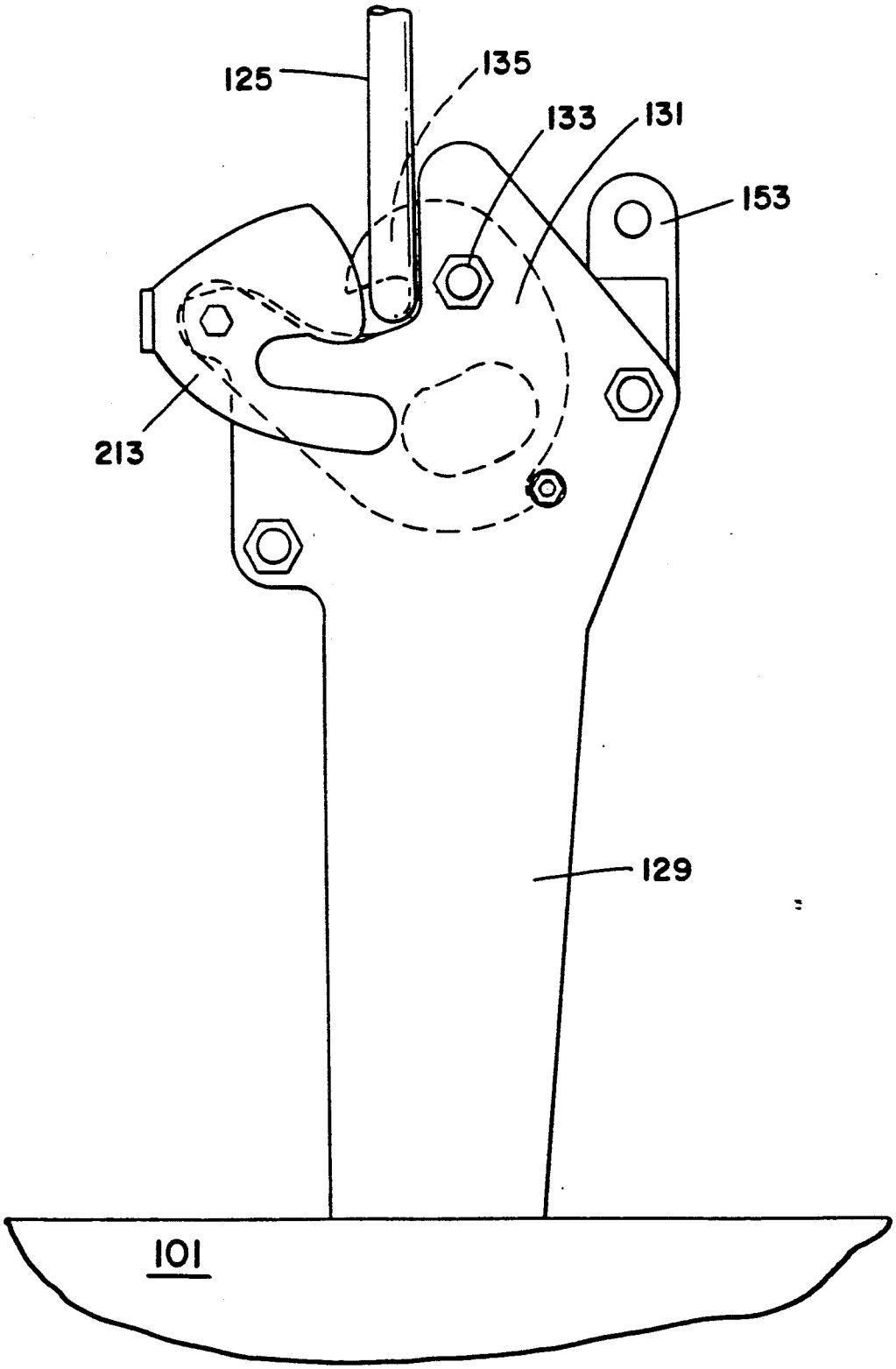
FIG. 2 is a sectional view that illustrates a Viking on load release mechanism.
Figure 3:
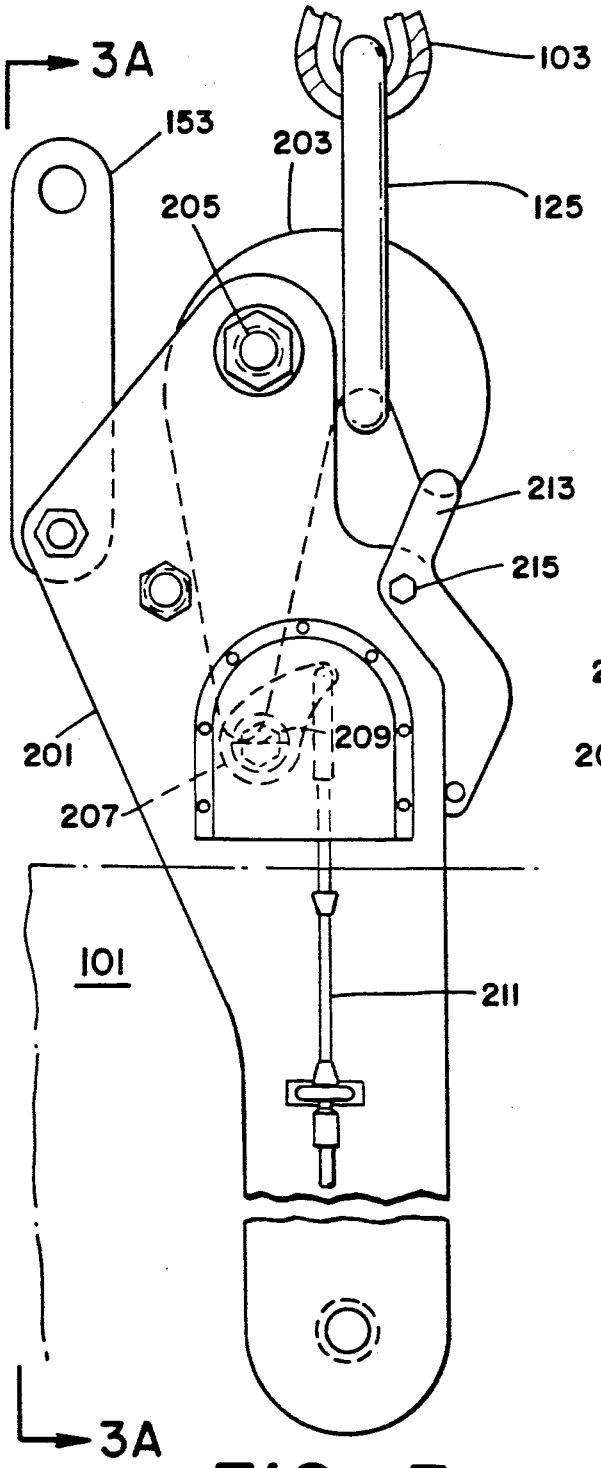
FIG. 3 and 3A are sectional views that illustrate a Titan on load release mechanism.

The on load release mechanism 127 such as a "Viking" on load release mechanism shown in FIG. 2 or a Titan on load release mechanism shown in FIG. 3 permits the launch pendant 103 to be manually released from the lifeboat 101 before or after the lifeboat reaches the water.

The Viking on load release mechanism as further illustrated in FIG. 2 is also comprised of galvanized steel components. The lower portion of hook sideplate 129 is attached to the lifeboat 101. At the upper end of the sideplate 129, a lift hook 131 is pivotally connected to the upper portion of the side plate 129 by bolt 133. The lift hook 131 has a released position and a biased secured position. The lift hook 131 is biased to its secured position by tension provided by release cables. The lift hook 131 can be activated manually by releasing the tension on the release cables.

In its secured position, lift hook arm 135 extends horizontally, so that the steel ring 125 slidably engages the lift hook arm 135 to prevent the release of the launch pendant 103 and the lifeboat 101. The lift hook arm 135 is of sufficient length to permit the disengagement of the steel ring 125 from the lift hook 131 and the subsequent release of the lifeboat 101 from the launch pendant 103 upon an operator of the lifeboat activating the lift hook 131.

In another embodiment, as FIG. 3 illustrates, a Titan on load release mechanism is utilized Hook sideplates 201 is attached to the lifeboat 101. At the upper end of the hook sideplate 201, a hook 203 is pivotally connected to the sideplate 201 by bolt 205. The hook 203 has a released position and a secured position.

Figure 3A:
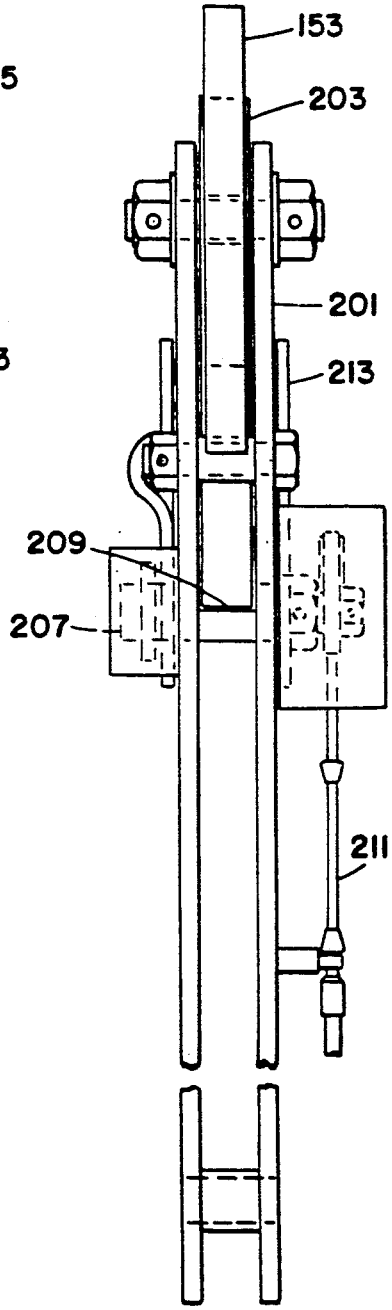

The hook 203 is held in its secured position by cam release pin 207 illustrated in FIG. 3*a*, which is rotatable about the hook sideplate 201. The cam release pin 207 has a flat notch 209 on one side. An operator can pull the operating cable 211 to cause the cam release pin 207 to rotate to an open position, whereby the hook 203 can pivot past the flat notch 209. Tension on the launch pendant 103 causes the hook 203 to pivot, thus releasing the ring 125 and the launch pendant 103. The hook 203 can be activated manually but is prevented from automatic release by a hydrostatic interlock. In its secured position, the hook 203 extends to be slidably engaged by the steel ring 125, to prevent the accidental release of the lifeboat 101 from the launch pendant 103. Guard plate 213 pivots about bolt 215 to prevent the release of the ring 125 until the hook 203 pivots.

It is desirable that the on load release mechanism 127 be of the type with a hydrostatic operating unit, for use with the present apparatus to help prevent the accidental release from the launch pendant 103 before contact with the water. The Mills "Titan" release gear, having a hydrostatic unit, or the "Viking" release gear without the hydrostatic unit, are particularly suitable for use with the present invention.

The Viking lift hook arm 135 or Titan hook 203 must be properly locked into place to prevent accidental release of the life boat 101 upon raising or lowering the life boat 101. The system design of the on load release mechanism 127 is such that the officer in charge could be led to believe that the lift hook 131 was properly set when in fact it was not. This is especially true if the lift hook 131 is reset prior to resetting the lift hook arm 135.

The operation of the Viking on load release mechanism and the Titan on load release mechanism is therefore very sophisticated. Accidental activation of a release hook, due either to operator error or mechanical malfunction has occurred in the past, and causes the premature release of the lifeboat from the launch pendant, often from a very high position above the sea. It is therefore advantageous to incorporate a safety system to prevent such accidents.

Figure 4:
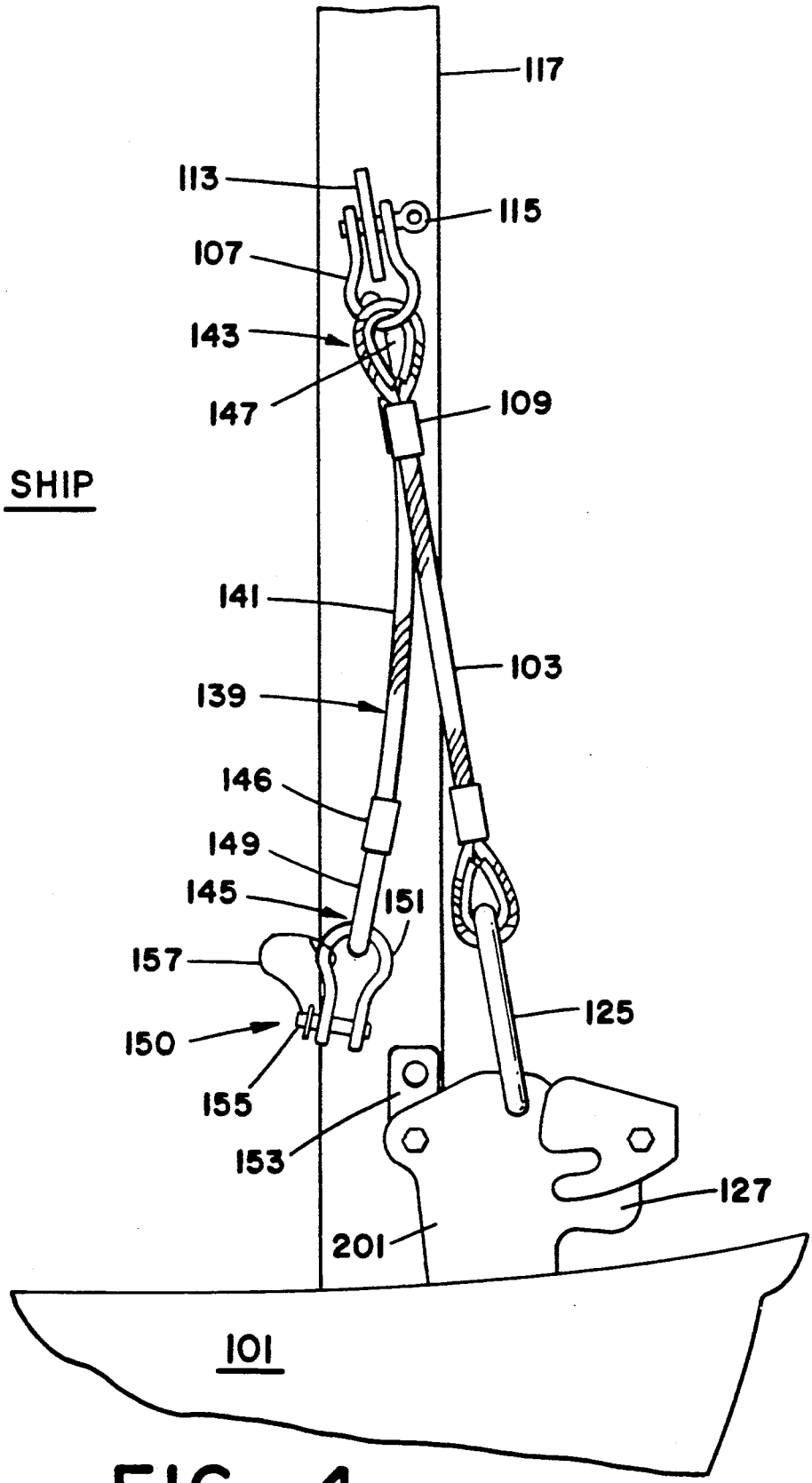
FIG. 4 is a side view that illustrates the lifeboat safety strop along with a ship carrying a lifeboat by means of a launch pendant.

FIG. 4 shows the inventive life boat safety strop 139 along with the lifeboat 101, the launch pendant 103 and the on load release mechanism 127 of FIG. 1.

In the preferred embodiment, the safety strop 139 is comprised of a connecting line 141. It is desirable that the connecting line 141 is made of galvanized steel cable to prevent rusting. The connecting line 141 has an upper end 143 which is connected to a shackle 107 in the same manner as the upper end of the launch pendant 103 is connected to the means for lowering the launch pendant 103 and lifeboat 101 into the water. In the preferred embodiment, the upper end 143 of the connecting line 141 is merged with the upper end 105 of the launch pendant 103, to form a single swedged eye 147 by means of steel clamp 109. The swedged eye 147 is connected to a shackle 107. The shackle 107 is pivotally connected to a padeye 113 by a pin 115. The padeye 113 is fixedly attached to a means 117 for lowering the safety strop 139 along with the launch pendant 103 and the lifeboat 101 to the water. A Miranda system is useful as a lowering means.

A lower end 145 of the connecting line 141 is also clamped by steel clamp 146 to form a swedged eye 149 to attach the connecting line 141 to a connecting line release means 150. A shackle 151 is a suitable release means. The shackle 151 is releasably connected to a hang off lug assembly 153 by a quick release pin 155. The quick release pin should be connected to the shackle 151 by a safety wire 157 to prevent the quick release pin from getting lost.

The hang off lug assembly 153 is fixedly attached to the hook side plate 201. The hang off lug assembly 153 is generally already located in this position as a tie-off for maintenance purposes.

The connecting line 141 has a length such that it is longer than the length of the launch pendant 103, so that no load is carried by the connecting line 141 unless the second lower end of the launch pendant 103 is released from the on load release mechanism 127. The quick release pin 155 is pulled from the shackle 151 to release the lifeboat 101, at a time when the operator decides that it is prudent to do so.

The lifeboat safety strop 139 thus reliably, inexpensively, and easily operates as a back up means to secure the lifeboat 101 until the operator of the lifeboat 101 decides to release the lifeboat 101.

In another embodiment, the upper end 143 of the connecting line 141 is not merged with the upper end 105 of the launch pendant 103 to form a single swedged eye 147. Instead, the upper end 143 of the connecting line 141 is clamped by an additional steel clamp, to form a swedged eye. The swedged eye is connected to the shackle 107 adjacent to the swedged eye at the upper end 105 of the launch pendant 103.

Figure 5:
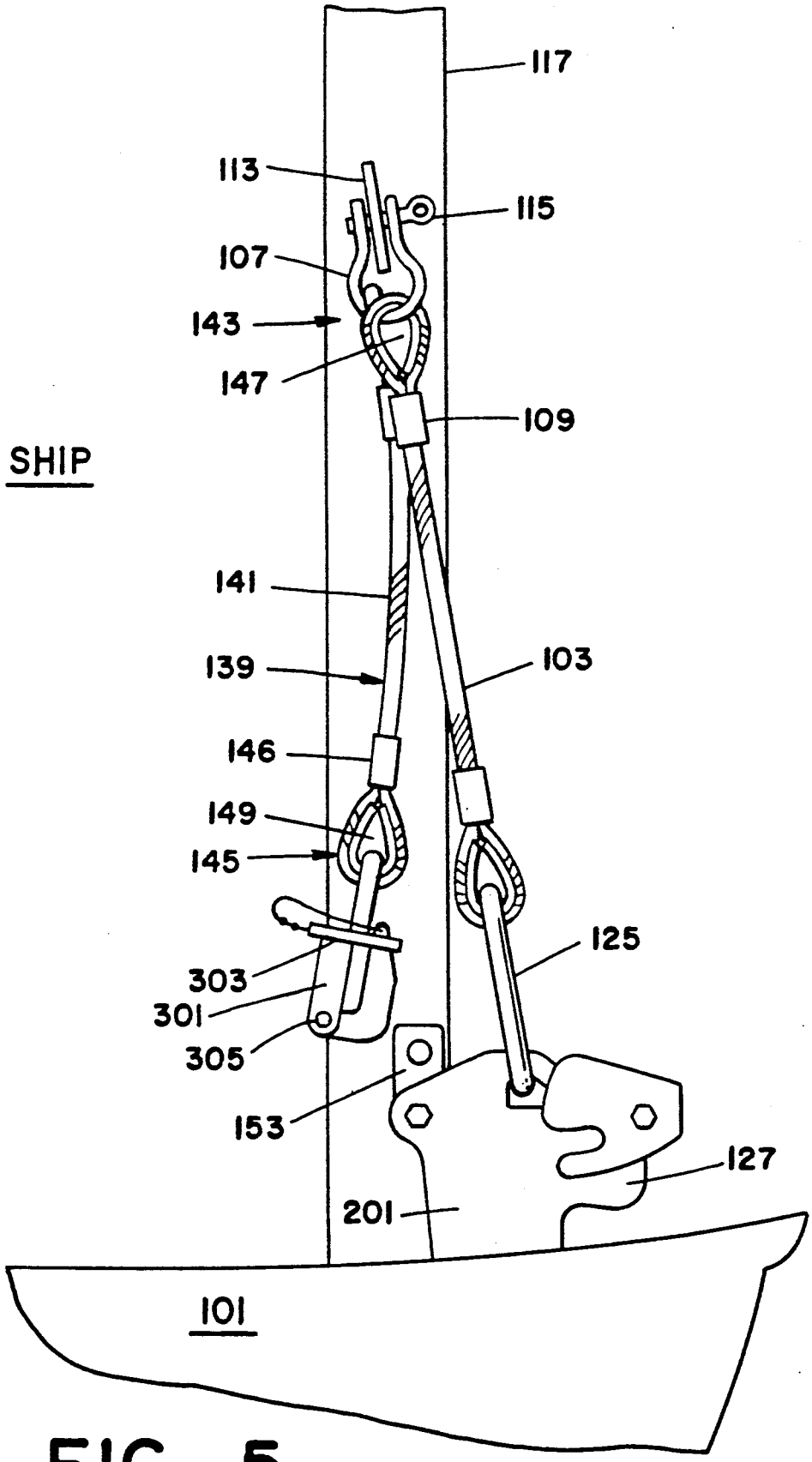
FIG. 5 is a side view that illustrates the lifeboat safety strop equipped with a pelican hook.

In still another embodiment, as illustrated in FIG. 5, the lower end 145 of the connecting line 141 is clamped by steel clamp 146 to form a swedged eye 149 to attach the connecting line 141 to a pelican hook 301. A pelican hook also is an all purpose hook that can be released while loaded. The pelican hook pivots by means of bolt 305. A release ring 303 is snapped shut to engage the hook. The release ring is pulled abruptly, or can be struck with an object such as a hammer, to open the hook.

While a preferred embodiment of the invention has been described and illustrated, it should be apparent that many modifications can be made thereto without departing from the spirit or scope of the invention. Accordingly, the invention is not limited by the foregoing description, but is only limited by the scope of the claims appended hereto.

What is claimed is:

1. A safety strop that prevents accidental freefall of a lifeboat, comprised of a connecting line, said connecting line having an upper end and a lower end, said upper end attached to a means for lowering a launch pendant and a lifeboat having an on load release means, said launch pendant having a first end attached to said lowering means near said upper end of said connecting line, and a second end releasably connected to said on load release means of said lifeboat, and said lower end of said connecting line connected to a connecting line release means; said connecting line release means releasably connected to a hang off lug assembly, said hang off lug assembly fixedly attached to said on load release means; and wherein said connecting line has a length that is longer than the length of said launch pendant so that no load is carried by said connecting line unless said second end of said launch pendant is released from said on load release means.

2. The safety strop of claim 1 wherein said connecting line is comprised of galvanized steel.

3. The safety strop of claim 2 wherein said upper end of said connecting line is merged with said launch pendant near said first end of said launch pendant.

4. The safety strop of claim 3, wherein said upper end of said connecting line is attached to a Miranda system for lowering a launch pendant and a lifeboat.

5. A safety strop that prevents accidental freefall of a lifeboat, comprised of a connecting line, said connecting line having an upper end and a lower end, said upper end attached to a means for lowering a launch pendant and a lifeboat having an on load release means, said launch pendant having a first end attached to said lowering means near said upper end of said connecting line, and a second end releasably connected to said on load release means of said lifeboat, and said lower end of said connecting line connected to a shackle; said shackle releasably connected to a hang off lug assembly by a release pin, said release pin attached to said shackle by a safety wire, and said lug assembly fixedly attached to said on load release means; and wherein said connecting line has a length that is longer than the length of said launch pendant so that no load is carried by said connecting line unless said second end of said launch pendant is released from said on load release means.

6. The safety strop of claim 5 wherein said connecting line is comprised of galvanized steel.

7. The safety strop of claim 6 wherein said upper end of said connecting line is merged with said launch pendant near said first end of said launch pendant.

8. The safety strop of claim 7 wherein said upper end of said connecting line is attached to a Miranda system for lowering a launch pendant and a lifeboat.

9. A safety strop that prevents accidental freefall of a lifeboat, comprised of a connecting line, said connecting line having an upper end and a lower end, said upper end attached to a means for lowering a launch pendant and a lifeboat having an on load release means, said launch pendant having a first end attached to said lowering means near said upper end of said connecting line, and a second end releasably connected to said on load release means of said lifeboat, and said lower end of said connecting line fixedly connected to a pelican hook; said pelican hook releasably connected to a hang off lug assembly by a securing ring slidable and pivotal attached to said pelican hook, and said lug assembly fixedly attached to said on load release means; and wherein said connecting line has a length that is longer than the length of said launch pendant so that no load is carried by said connecting line unless said second end of said launch pendant is released from said on load release means.

10. The safety strop of claim 9 wherein said connecting line is comprised of galvanized steel.

11. The safety strop of claim 10 wherein said upper end of said connecting line is merged with said launch pendant near said first end of said launch pendant.

12. The safety strop of claim 11, wherein said upper end of said connecting line is attached to a Miranda system for lowering a launch pendant and a lifeboat.

13. A safety strop that prevents accidental freefall of a lifeboat, comprised of a connecting line, said connecting line having an upper end and a lower end, said upper end attached to a means for lowering a launch pendant and a lifeboat having an on load release mechanism, said launch pendant having a first end attached to said lowering means near said upper end of said connecting line, and a second end releasably connected to said on load release mechanism of said lifeboat, and said lower end of said connecting line connected to a shackle; said on load release mechanism further comprising a hook side plate having an upper portion and a lower portion whereby said lower portion is attached to said lifeboat, a lift hook having a lift hook arm is pivotally connected to said upper portion, said lift hook having a biased secured position and a released position, so that said lift hook arm extends in a nearly horizontal direction when in its secured position to slidably engage said second end of said launch pendant, said lift hook arm activatable to pivot into said released position, to release or to prevent the release of said launch pendant, and a guard plate attached to said hook side plate so that said guard plate can be positioned to overlap and protect said lift hook; said shackle releasably connected to a hang off lug assembly by a release pin, said release pin attached to said shackle by a safety wire, and said lug assembly fixedly attached to said on load release means; and wherein said connecting line has a length that is longer than the length of said launch pendant so that no load is carried by said connecting line unless said second end of said launch pendant is released from said on load release mechanism.

14. The safety strop of claim 13 wherein said connecting line is comprised of galvanized steel.

15. The safety strop of claim 14 wherein said upper end of said connecting line is merged with said launch pendant near said first end of said launch pendant.

16. The safety strop of claim 15, wherein said upper end of said connecting line is attached to a Miranda system for lowering a launch pendant and a lifeboat.

17. A safety strop that prevents accidental freefall of a lifeboat, comprised of a connecting line, said connecting line having an upper end and a lower end, said upper end attached to a means for lowering a launch pendant and a lifeboat having an on load release mechanism, said launch pendant having a first end attached to said lowering means near said upper end of said connecting line, and a second end releasably connected to said on load release mechanism of said lifeboat, and said lower end of said connecting line connected to a pelican hook said on load release mechanism further comprising a hook side plate having an upper portion and a lower portion whereby said lower portion is attached to said lifeboat, a lift hook having a lift hook arm is pivotally connected to said upper portion, said lift hook having a biased secured position and a released position, so that said lift hook arm extends in a nearly horizontal direction when in its secured position to slidably engage said second end of said launch pendant, said lift hook arm activatable to pivot into said released position, to release or to prevent the release of said launch pendant, and a guard plate attached to said hook side plate so that said guard plate can be positioned to overlap and protect said lift hook; said pelican hook releasably connected to a hang off lug assembly by a securing ring slidably and pivotally attached to said pelican hook, and said lug assembly fixedly attached to said on load release mechanism; and wherein said connecting line has a length that is longer than the length of said launch pendant so that no load is carried by said connecting line unless said second end of said launch pendant is released from said on load release mechanism.

18. The safety strop of claim 17, wherein said connecting line is comprised of galvanized steel.

19. The safety strop of claim 18, wherein said upper end of said connecting line is merged with said launch pendant near said first end of said launch pendant.

20. The safety strop of claim 19 wherein said upper end of said connecting line is attached to a Miranda system for lowering a launch pendant and a lifeboat.

* * * * *